US007137317B2

(12) United States Patent
Shearon

(10) Patent No.: US 7,137,317 B2
(45) Date of Patent: Nov. 21, 2006

(54) CONTAINER LID OPENING DEVICE AND METHOD

(75) Inventor: James C. Shearon, Greenwood Village, CO (US)

(73) Assignee: Home Services 2000, Inc., Greenwood Village, CO (US)

( * ) Notice: Subject to any disclaimer, the term of this patent is extended or adjusted under 35 U.S.C. 154(b) by 181 days.

(21) Appl. No.: 10/910,170

(22) Filed: Aug. 2, 2004

(65) Prior Publication Data

US 2006/0021471 A1 Feb. 2, 2006

(51) Int. Cl.
*B67B 7/40* (2006.01)
*B65D 17/36* (2006.01)

(52) U.S. Cl. ..... 81/3.55; 81/3.4; D8/40

(58) Field of Classification Search ..... 81/3.55, 81/3.09, 3.07, 3.4, 3.47, 3.48, 3.49; D8/33, D8/18, 40; 220/274
See application file for complete search history.

(56) References Cited

U.S. PATENT DOCUMENTS

| | | | | | |
|---|---|---|---|---|---|
| 321,056 | A | * | 6/1885 | Saupiquet | 220/274 |
| RE11,264 | E | * | 8/1892 | Pratt | 220/274 |
| 5,054,337 | A | * | 10/1991 | Bonicelli, Jr. | 81/3.07 |
| 5,095,777 | A | * | 3/1992 | Osmar et al. | 81/3.09 |

* cited by examiner

*Primary Examiner*—Hadi Shakeri
(74) *Attorney, Agent, or Firm*—Sheridan Ross, P.C.

(57) ABSTRACT

A container opening device and method are provided to facilitate the opening of containers of the type having integral pull tabs. The device includes a body, a tip located at one end of the body, and a handle located at the opposite end of the body. A slot is formed in the body and is positioned between the handle and the tip. The device is first used as a lever to rotate the pull tab to an activated position. The pull tab is then inserted within the slot formed in the body, and the handle of the device is rotated while securing the pull tab in the slot causing the lid to roll around the body thus separating the lid from the container.

4 Claims, 3 Drawing Sheets

Fig. 1
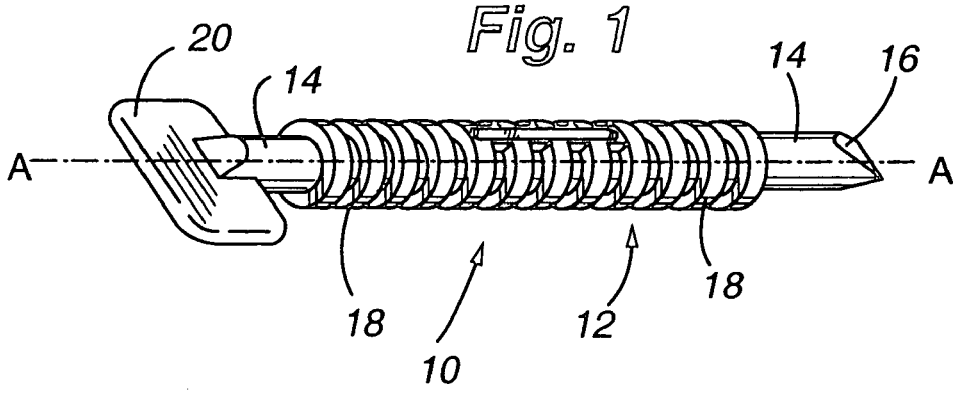
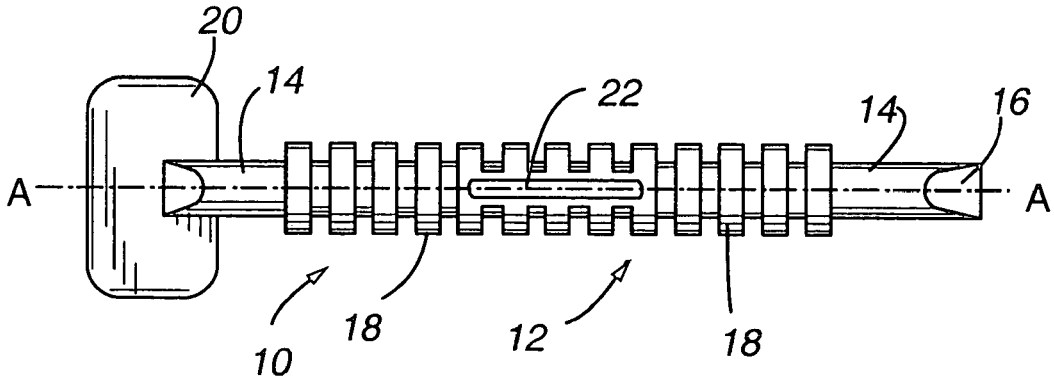
Fig. 2
Fig. 3
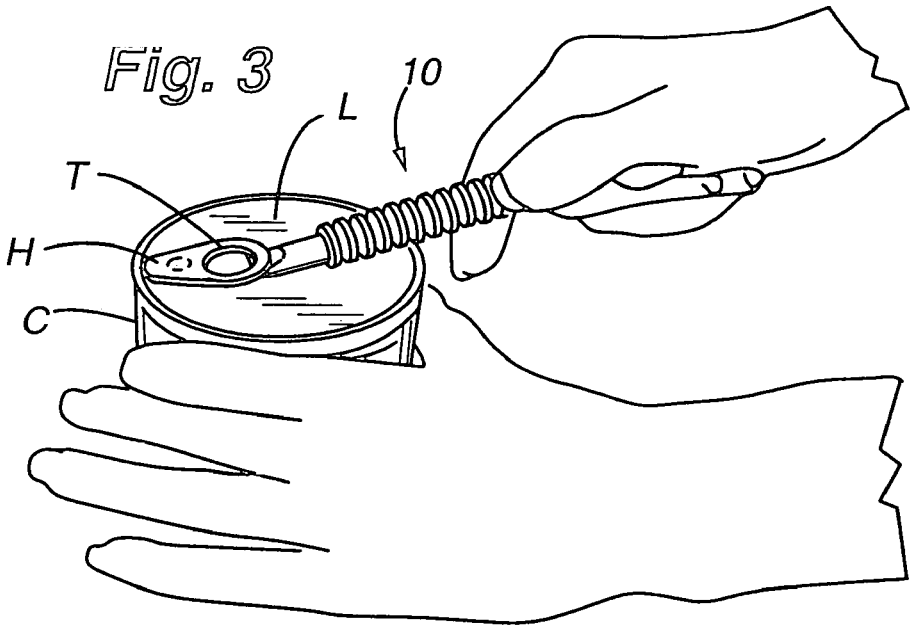

CONTAINER LID OPENING DEVICE AND METHOD

FIELD OF THE INVENTION

The present invention relates to a device and method for removing the lid of a container, and more particularly, to a method and apparatus especially adapted for opening a container having a lid with an integral pull tab.

BACKGROUND OF THE INVENTION

Products are stored in a wide variety of containers. For food products and beverages, common containers include sealed cans, bottles, and containers made of metal or cardboard/compressed papers with detachable sealed lids. More recently, containers having detachable sealed lids have become popular for storage of many food products. These containers may include an integral pull tab that is used to detach the lid from the container.

While sealed containers with detachable lids and integral pull tabs may be well suited for storage of various goods, one drawback with the design of these containers is that opening the containers requires considerable force to be applied to the pull tab in order to activate the pull tab and to remove the lid from the container by pulling on the pull tab.

Therefore, there is a need for a device that facilitates opening of these containers by providing a user with a mechanical advantage in manipulating the pull tabs.

SUMMARY OF THE INVENTION

It is therefore one object of the present invention to provide a device that facilitates easier opening of a container lid without damaging the container. It is yet another object to provide a user with a mechanical advantage in opening the container by use of a simple hand tool. The mechanical advantage that is achieved with the device of the present invention also helps to prevent potential injury to the user, such as broken nails, cuts, or strained muscles. Furthermore, spillage of container contents is also avoided by being able to better control opening of the container. Normally, a user opens the container by inserting a finger in the opening of the pull tab, rotating the pull tab to break the seal of the lid, and then pulling back on the pull tab to remove the lid from the container. A considerable amount of force has to be applied to the pull tab in order to activate the pull tab to break the lid seal. Additionally, a considerable amount of force has to be used to detach the lid from the container by pulling on the pull tab. It is difficult for the user to interrupt the force applied to the lid at the instant the seal is fully broken, resulting in the user being unable to sufficiently steady the container to prevent spillage as the lid is detached.

The device of the present invention comprises a body portion characterized by a central shaft and a plurality of annular projections extending from the central shaft, a beveled tip formed at a distal end of the body, a handle formed on the opposite end of the body, and a slot that is shaped to receive the pull tab of the container. The device is symmetrical about a central or longitudinal axis.

In operation, the beveled tip is placed under the pull tab, and the user lifts up on the handle thereby using the body of the device as a lever to assist in activation of the pull tab. Activation of the pull tab is achieved by rotation of the pull tab to break the seal of the lid. To remove the lid from the container, the pull tab is inserted within the slot of the device. The handle is then rotated while securing the pull tab so that the lid is incrementally rolled around the body of the device.

Other features and advantages of the present invention will become apparent from the detailed description that follows, taken in conjunction with the drawings.

BRIEF DESCRIPTION OF THE DRAWINGS

FIG. 1 is a perspective view of a preferred embodiment of the device of the present invention;

FIG. 2 is a plan view of the device;

FIG. 3 illustrates use of the device in an initial step of activating the pull tab;

DETAILED DESCRIPTION

Figure 4:
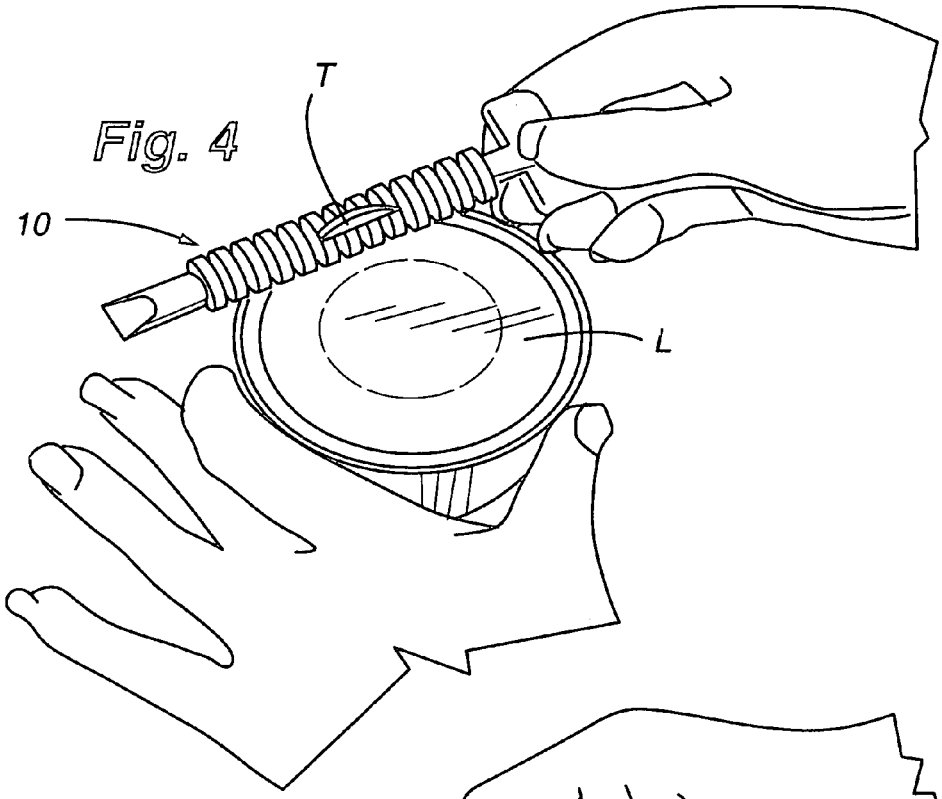
FIG. 4 illustrates insertion of the pull tab in the slot of the device.

Referring first to FIGS. 1 and 2, the device 10 of the present invention is characterized by a body 12 defined by a central shaft or extension 14, and a plurality of annular projections 18 spaced from one another longitudinally along the shaft. The annular projections are not required, and are shown in the preferred embodiment because the device is preferably made in an injection molding process. It is more economical to mold the present invention with the projections to reduce the amount of material used, and the injection molding process itself is simplified by reducing required pressures and dwell times during injection. Therefore, it shall be understood that while provision of the projections is preferred for manufacture by injection molding, the central shaft could simply be a smooth cylindrical member. A distal end of the device includes a beveled tip 16 characterized by a pair of converging surfaces. The proximal end of the device includes a handle 20 defined by a flat projection attached to the extension 14. A slot 22 is formed through the body of the device, and is preferably centered between the proximal and distal ends. The slot has a thickness that is sized to receive the pull tab T of a container C, and to capture the pull tab T when the device is rotated.

Referring now to FIG. 3, a user first inserts the beveled tip 16 under the pull tab T of the container C. The tip is inserted far enough under the pull tab so that when the user pulls up on the device 10, the device will act as a lever to cause activation of the pull tab so that the head H of the pull tab T rotates to break the seal of the lid L. The seal of the lid L is typically broken along a score line formed on a periphery of the lid.

Figure 5:
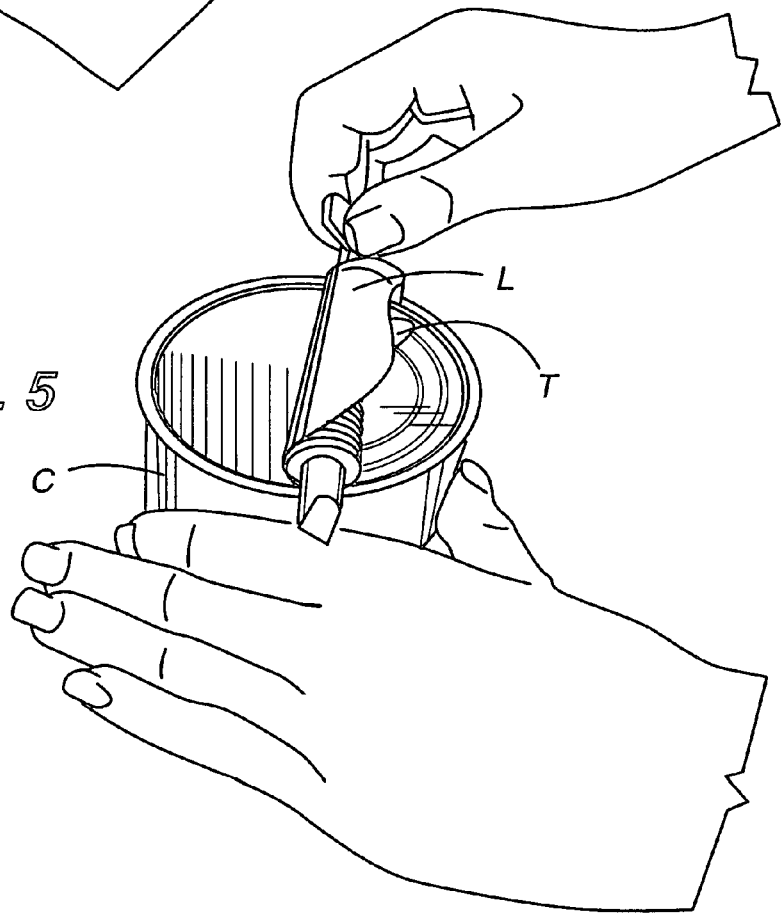
FIG. 5 illustrates removal of the lid from the container by rotation of the handle thereby resulting in rolling of the lid about the body of the device.

Referring to FIGS. 4 and 5, after the pull tab has been activated, a user inserts the pull tab T within the slot 22. The user then rotates the handle so that the lid is rolled about the body of the device. The handle of the device provides a mechanical advantage in breaking the seal of the lid. The incremental rotation of the handle by the user enables the user to steadily apply an amount of force necessary to gradually break the seal on the lid. This selective and incremental application of force helps a user to better control the removal of the lid, to prevent damage to the container, and to prevent potential injury to the user.

Figure 6:
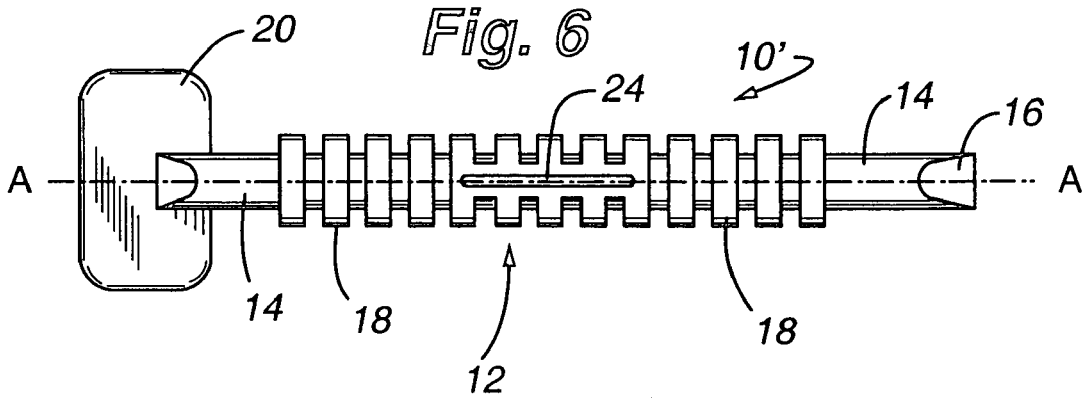
FIG. 6 illustrates a modification to the preferred embodiment wherein the slot has a narrower width.

FIG. 6 illustrates a modified device 10' that includes a slot 24 having a different size than that of the slot 22. More specifically, the slot 24 simply has a narrower width that may accommodate other types of pull tabs that may be found on containers.

Figure 7:
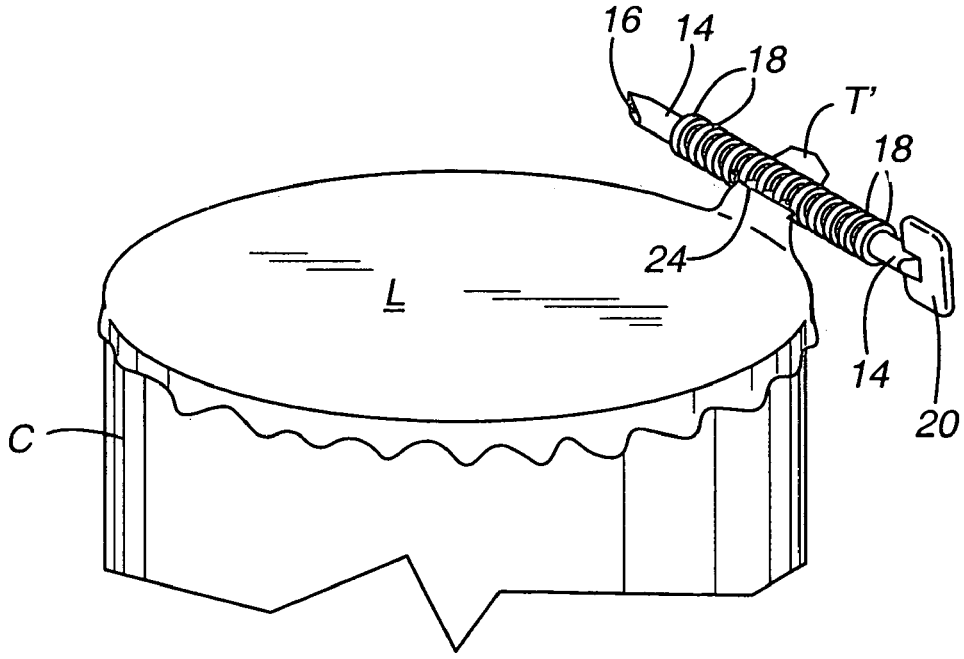
FIG. 7 illustrates a container having a different type of pull tab that has been inserted through the modified slot of the device shown in FIG. 6.

Referring now to FIG. 7, the container C illustrated there may include a lid L that is made of cellophane, tin foil, or other flexible material. The pull tab T' of this particular lid L is typically made of the same material as the lid, and therefore simply forms an extension of the lid that is not sealed with respect to the container. In order to effectively capture the tab T', the width of the slot 24 is narrower as compared to slot 22. To remove the lid L, a user inserts the tab T' in slot 24, and then rotates the handle of the device so that the flexible lid wraps around the body of the device.

In accordance with the method of the present invention, removal of a lid of a container is achieved by using the device as a lever to first activate a pull tab. The pull tab is then inserted within a slot of the device, and the device is then rotated to detach the lid from the container. For pull tabs that do not have to be activated, i.e., those pull tabs like shown in FIG. 7 that simply form an extension of the lid, an activation step is not required.

Although the present invention has been described with respect to a preferred embodiment thereof, it shall be understood that various other changes and modifications may be made within the spirit and scope of the present invention as claimed.

What is claimed is:

1. A device especially adapted for opening containers having an integral pull tab for removal of a lid of the container, said device comprising:

a cylindrical shaped body;

a tip formed on a first end of said body, said tip having a bevel comprising a pair of converging surfaces that converge to form a most distal edge of said first end;

a handle formed on a second opposite end of said body, said handle having a flat projection extending longitudinally away from said second opposite end and extending transversely away from said second opposite end;

a slot formed through said body for receiving the pull tab of the container; and a plurality of annular projections formed on said body and spaced from one another longitudinally along said body, said annular projections extending circumferentially around said body, wherein said slot is located along said annular projections.

2. A device, as claimed in claim 1, wherein:

said device is symmetrical about a longitudinal axis.

3. A device, as claimed in claim 1, wherein:

said slot has a thickness, and a length that extends longitudinally along said body.

4. A method of removing a lid from a container, the container being of the type having an integral pull tab, said method comprising the steps of:

providing a device comprising (i) a cylindrical shaped body, (ii) a tip formed on one end of the body, said tip having a bevel comprising a pair of converging surfaces defining a most distal edge extending transversely to a longitudinal axis of said device, (iii) a handle formed on an opposite end of the body, (iv) a slot extending through said body, said slot positioned between the handle and the tip, and (v) a plurality of annular projections formed on said body and spaced from one another longitudinally along said body, said annular projections extending circumferentially around said body, wherein said slot is located along said annular projections;

inserting the tip of the device under a pull tab of a container;

lifting on the handle to rotate the pull tab to an activated position;

inserting the pull tab in the slot; and rotating the device while securing the pull tab in the slot resulting in the lid rolling around the body of the device and thereby incrementally breaking a seal of the lid to remove the lid from the container.

* * * * *